US008122667B2

(12) United States Patent
Ferge et al.

(10) Patent No.: US 8,122,667 B2
(45) Date of Patent: Feb. 28, 2012

(54) SEAM CLIP HAVING THERMAL BARRIER

(75) Inventors: Dan Ferge, Janesville, WI (US); Doug Wilburn, Monticello, IN (US)

(73) Assignee: A. Raymond et Cie, Grenoble (FR)

( * ) Notice: Subject to any disclaimer, the term of this patent is extended or adjusted under 35 U.S.C. 154(b) by 208 days.

(21) Appl. No.: 12/218,328

(22) Filed: Jul. 14, 2008

(65) Prior Publication Data

US 2009/0126303 A1 May 21, 2009

Related U.S. Application Data

(60) Provisional application No. 60/949,713, filed on Jul. 13, 2007.

(51) Int. Cl.
*E04D 1/34* (2006.01)

(52) U.S. Cl. ..... 52/544; 52/547; 52/713; 52/717.02

(58) Field of Classification Search ..... 52/410, 52/520, 521, 537, 543–547, 713, 717.02
See application file for complete search history.

(56) References Cited

U.S. PATENT DOCUMENTS

| | | | | |
|---|---|---|---|---|
| 326,958 | A | 9/1885 | Eller | |
| 1,882,105 | A | 10/1932 | Wender | |
| 4,034,532 | A * | 7/1977 | Reinwall, Jr. | 52/520 |
| 4,296,581 | A | 10/1981 | Heckelsberg | |
| 4,337,606 | A | 7/1982 | Reusser | |
| 4,346,543 | A * | 8/1982 | Wilson et al. | 52/404.2 |
| 4,348,846 | A * | 9/1982 | Bellem | 52/410 |
| 4,429,508 | A * | 2/1984 | Sizemore | 52/713 |
| 4,514,952 | A | 5/1985 | Johansson | |
| 4,570,404 | A | 2/1986 | Knudson | |
| 4,570,405 | A | 2/1986 | Knudson | |
| 4,575,983 | A | 3/1986 | Lott, Jr. et al. | |
| 4,651,489 | A * | 3/1987 | Hodges et al. | 52/409 |
| 4,706,434 | A | 11/1987 | Cotter | |
| 4,807,414 | A | 2/1989 | Krause | |
| 5,001,881 | A | 3/1991 | Boyd | |
| 5,001,882 | A | 3/1991 | Watkins et al. | |
| 5,127,205 | A | 7/1992 | Eidson | |
| 5,181,360 | A * | 1/1993 | Shingler | 52/520 |

(Continued)

FOREIGN PATENT DOCUMENTS

EP 225931 A1 * 6/1987

OTHER PUBLICATIONS

Intl Sea Rpt/Written Opin, Jun. 11, 2009, Tinnerman Palnut Engineer.

*Primary Examiner* — Brian Glessner
*Assistant Examiner* — Adriana Figueroa
(74) *Attorney, Agent, or Firm* — McDonald Hopkins LLC

(57) ABSTRACT

A seam clip assembly is disclosed. The seam clip assembly includes a seam clip attachable to a thermal barrier. The seam clip is connected to the thermal barrier, and the thermal barrier is connected to a structure, such as a roofing structure. The thermal barrier prevents or at least limits heat conduction from the seam clip into the roofing structure. The thermal barrier improves uplift strength of the seam clip attached to adjoining roofing panels.

16 Claims, 3 Drawing Sheets

U.S. PATENT DOCUMENTS 5,222,341 A 6/1993 Watkins et al.
5,511,354 A 4/1996 Eidson
5,685,118 A 11/1997 Simpson
5,692,352 A 12/1997 Simpson
5,697,197 A 12/1997 Simpson
5,737,894 A 4/1998 Simpson et al.
5,867,959 A * 2/1999 Ruble et al. ..... 52/545
5,911,663 A 6/1999 Eidson
6,301,853 B1 10/2001 Simpson et al.
6,715,256 B1 4/2004 Fischer
6,889,478 B1 5/2005 Simpson
2005/0011154 A1* 1/2005 Kim ..... 52/506.06
2005/0193644 A1* 9/2005 Simpson et al. ..... 52/91.3
2006/0174571 A1* 8/2006 Panasik et al. ..... 52/478

* cited by examiner

SEAM CLIP HAVING THERMAL BARRIER

CROSS-REFERENCE TO RELATED APPLICATIONS

This application claims benefit from U.S. Provisional Patent Application No. 60/949,713, entitled "Seam Clip Having Thermal Barrier," filed on Jul. 13, 2007, which is hereby incorporated in its entirety by reference.

FIELD OF THE INVENTION

The present invention generally relates to a clip having a thermal barrier, and more specifically to a seam clip attachable to a thermal barrier.

BACKGROUND OF THE INVENTION

Standing seam clip assemblies are frequently installed to secure adjacent roofing panels. One of the primarily reasons seam clips are used on roofing panels is due to the desire to avoid penetration into roofing panels, such as when securing the roofing panels to the underlying building support structures. In addition, standing seam roofs utilize connectors that provide for expansion and contraction of the roofing panels, especially metal roofing panels.

Seam clips typically have tabs shaped to maintain a watertight seal about the slip tab in the finally formed standing seam assembly. A watertight seal is usually achieved by a factory-applied bead of sealant disposed on the underside of the female sidelap. As adjacent panel sidelaps are seamed, the sealant material is pressed against the top side of the male sidelap to form a watertight dam, preventing water and air from moving between the two sidelaps in the final standing seam assembly.

Typically insulation, such as, foam or fiber glass is positioned between a purlin (a building structure member) and the base of the seam clip. The clip fasteners penetrate the purlin and are tightened to compress the insulation so that the clip base is mounted against the top surface of the purlin. The insulation is required to insulate the purlin from heat from the exterior of the structure and the seam clip. However, the fasteners securing the seam clip base penetrate the purlin and the insulation and, as a result, transfer heat directly from the seam clip body to the purlin. Therefore, a need exists for an improved seam clip that is capable of preventing thermal transfer from the roof panels to the interior of the building structure.

Moreover, known seam clips have low uplift strength. Typically, fasteners attached to the clip body secure the seam clip directly to each purlin. Seams clips are frequently exposed to wind or other forces that can create a strong upward force on the seam clips, namely on the attachment of the clip bodies to each purlin. As a result, known seam clips may become dislodged from the purlins.

Therefore, a need exists for a seam clip capable of an improved attachment to a purlin or other frame member. Further, a need exists for a seam clip capable of attaching to a purlin that prevents thermal transfer directly to the purlin. A still further need exists for a seam clip capable of attachment to a base or purlin member in such a way as to increase uplift strength.

SUMMARY OF THE INVENTION

A seam clip assembly including a seam clip having a base portion and a clip portion is provided. A thermal barrier may be secured to the seam clip. The thermal barrier may comprise a material that dissipates or prevents heat conduction from the seam clip. The seam clip may be used to secure adjoining roofing panels to a structure, such as a purlin structure of a building. The thermal barrier may prevent or at least limit heat from the seam clip for conduction into the purlin structure of the building.

BRIEF DESCRIPTION OF THE SEVERAL VIEWS OF THE DRAWING

Objects and advantages together with the operation of the invention may be better understood by reference to the following detailed description taken in connection with the following illustrations, wherein.

DETAILED DESCRIPTION OF THE INVENTION

While the present invention is described with reference to embodiments described herein, it should be clear that the present invention is not limited to such embodiments. Therefore, the description of the embodiments herein is merely illustrative of the present invention and will not limit the scope of the invention as claimed.

Figure 1A:
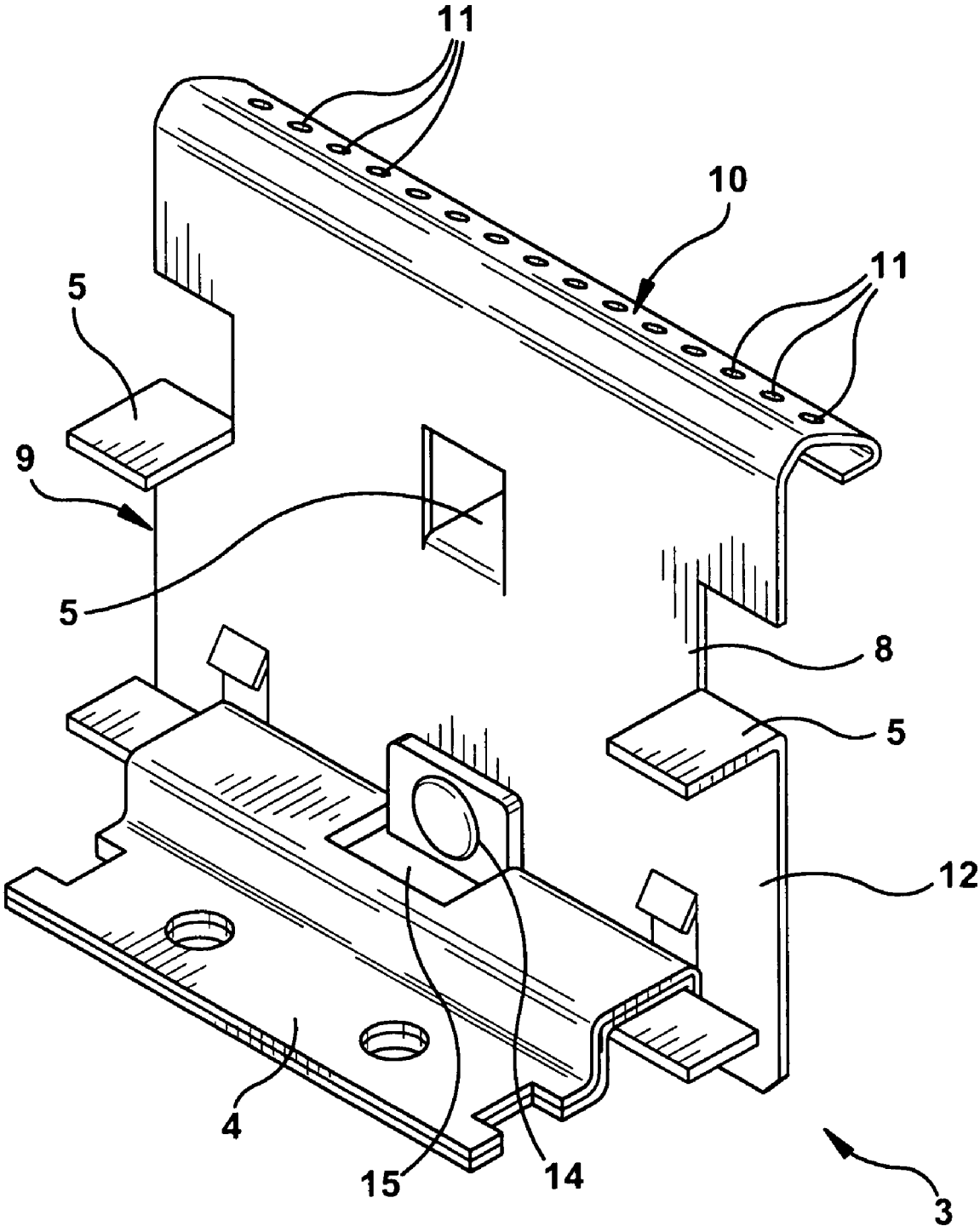
FIG. 1A is a perspective view of a seam clip body in an embodiment of the present invention.
Figure 1B:
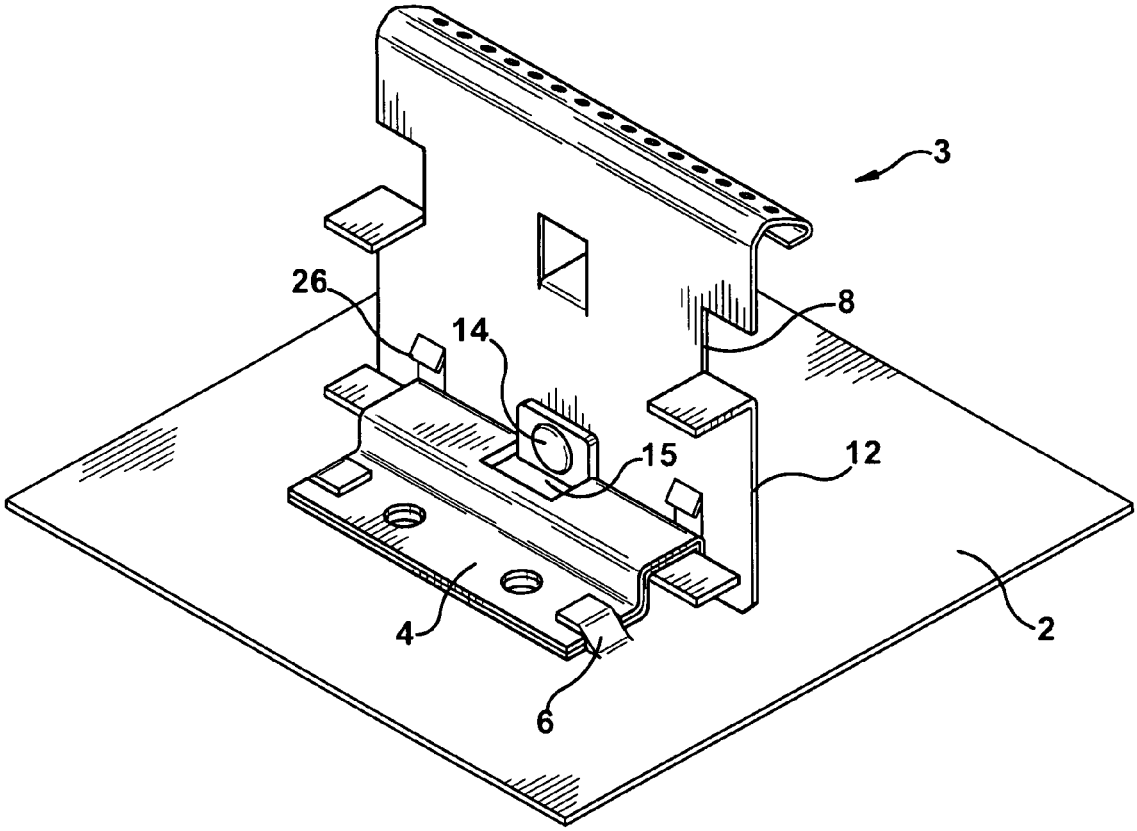
FIG. 1B is a perspective view of a seam clip body secured to a barrier plate in an embodiment of the present invention.

Referring now to the drawings, and in particular to FIGS. 1A and 1B, a seam clip 3 having a seam clip body 8 and a base 4 is illustrated. The seam clip body 8 may have an upstanding portion 9 and a clip (or sidelap) portion 10. The upstanding portion 9 may extend from the base 4. For example, the upstanding portion 9 may extend in a substantially vertical direction away from the base 4. The upstanding portion 9 may be capable of connection to or engagement with roofing panels, such as adjoining roofing panels. One or more supports 5 may be formed in and/or incorporated into the upstanding portion 9. The supports 5 may, for example, consist of portions of the upstanding portion 9 bent or folded outward from the upstanding portion 9. In an embodiment, the supports 5 may extend from the seam clip body 8 in a substantially perpendicular direction from the upstanding portion 9 and/or the seam clip body 8. The roofing panels, for example, may contact, may engage and/or may abut the supports 5.

The clip portion 10 may be located at or adjacent to an end of the upstanding portion 9. The clip portion 10 may be folded, such as folded inward at its edge. For example, the clip portion 10 may be folded such that the clip portion 10 is sized and shaped to engage sidelaps of adjoining roofing panels. In an embodiment, the clip portion 10 may be bent or folded into a "c"-like or "e"-like shape.

The clip portion 10 may have one or more apertures 11 positioned along the clip portion 10. During installation, for example, sealant material may be applied to the clip portion 10, such as the underside and/or the top side of the clip portion 10. The sealant material may form a watertight dam, preventing water and air from moving between the two sidelaps in the final standing seam assembly. The sealant material may be applied prior to connecting the clip portion 10 to adjoining roofing panels. As adjacent panel sidelaps are seamed, the sealant material may be pressed against the top side of the male sidelap, for example, such that the sealant squeezes or otherwise penetrates the apertures 11. Advantageously, the sealant material may be applied to both sides of the clip portion 10 and, as a result, to the adjoining roofing panels, such as the sidelaps of the adjoining roofing panels. Of course, one of ordinary skill in the art will appreciate that the sealant material may be applied to either or both sides of the clip portion 10 and/or roofing panels and/or may be used without the sealant material.

The body 8 may have a protruding member 14 extending away from or outward from the body 8. In an embodiment, the protruding member 14 may extend in a direction from the body 8, such as opposite the direction in which the clip portion 10 extends from the body 8. The protruding member 14 may engage an aperture 15 (or slot) in the base 4. The protruding member 14 may be a pin, a nut, a bolt, an enlarged portion of the body 8, and/or any other member capable of engaging the base 4. The engagement of the protruding member 14 and the aperture 15 may align to position the seam clip body 8 with respect to the base 4, for example, to center the seam clip body 8 with respect to the base 4. In an embodiment, the aperture 15 may be sized to permit axial movement in aligning the seam clip body 8 to allow for expansion, contraction, or other desired movement of the roofing panels. In such an embodiment, the aperture 15 may limit the axial movement, such as to a portion of the axial length of the seam clip body 8 with respect to the base 4.

Slide stops 12 may be positioned at or adjacent to opposing ends of the clip body 8. The slide stops 12 may engage the base 4 of the seam clip 3. The slide stops 12 may, for example, protrude away from the body 8 to engage the base 4 of the seam clip 3. In an embodiment, the slide stops may include biased members that contact and/or grip the base 4 to prevent lateral movement of seam clip 3. The slide stops 12 may prevent or may limit the clip body 8 from sliding or otherwise moving axially along the base 4. The slide stop 12 may permit a predetermined amount of lateral movement of the clip body 8 to, for example, compensate for expansion, contraction, and other desired movement of the adjoining roof panels.

The seam clip 3 may be connected to a thermal barrier that may dissipate and/or may prevent thermal energy, such as heat from the seam clip 3 to transmit into, for example, the purlin or interior of the structure within the adjoining roofing panels. The thermal barrier may be connected to adjoining roof panels and/or the seam clip 3.

In an embodiment, the thermal barrier is a barrier plate 2 attachable to the base 4 of the seam clip 3. The barrier plate 2 may be connected to the seam clip 3 and/or the adjoining roof panels. The barrier plate 2 may be sized and capable of attachment to one or more purlins. For example, the barrier plate 2 may be attached directly to purlins of a building, for example. The barrier plate 2 may provide a relatively large surface area to aid in dissipating and preventing thermal energy from the seam clip 3 and, as a result, limiting, if not eliminating, thermal energy from the seam clip 3 from passing into the interior of the structure or purlin, for example. In an embodiment, the barrier plate 2 may be substantially larger in size than the base 4 of the seam clip 3. To this end, thermal changes occurring to the seam clip body 8 are transferred to the barrier plate 2 due to the relative size of the barrier plate 2 with respect to the seam clip 3.

In use, the barrier plate 2 may be a predetermined size and shape. For example, the size of the barrier plate 2 may correspond to and/or may relate to the distance between adjoining roofing panels and/or the number of seam clips 3 required for securing the roofing panels. In an embodiment, one or more of the barrier plates 2 may be positioned about the roofing assembly and/or the purlins of the building structure. The barrier plates 2 may be attached to the purlins and may be separated from the purlins, by insulation, for example. The barrier plate 2 may assist in uniformally spreading and/or otherwise positioning insulation that may be located between the purlin and the barrier plate 2. As a result, thermal changes from the barrier plate 2 are effectively absorbed by the insulation. The barrier plate 2 eliminates direct connection of the seam clip body 8 to the purlin. No portion of the seam clip is directly connected to the purlin or other structure. The barrier plate 2 may provide a thermal barrier to reduce thermal transfers from the seam clip 3 to the purlin.

The seam clip body 8 may be attachable to the barrier plate 2 to properly position the seam clip 3 with respect to the adjoining roofing panels. In an embodiment, the barrier plate 2 may be attached to the base 4 without the need of fasteners. For example, the barrier plate 2 may have retaining clips 6 to secure the base 4 to the barrier plate 2. The retaining clips 6 may be attached to and/or integrally formed with the barrier plate 2. The retaining clips 6 may ease in assembly and may assist in properly positioning the seam clip body 8 with respect to the adjoining roofing panels. In addition, the barrier plate 2 and retaining clips 6 improve the uplift strength of the seam clip 3.

The retaining clips 6 may be spring loaded or otherwise biased to a locked position. In one embodiment, the base 4 of the seam clip 3 may be forced or otherwise inserted between the retaining clips 6 to move the retaining clips to an unlocked position. The retaining clips 6 may move from the unlocked position to the locked position when the base 4 is properly positioned on the barrier plate 2. The locked position of the retaining clips 6 may prevent axial and lateral movement of the base 4 of the seam clip 3 with respect to the barrier plate 2. The clip portion 10 may move with respect to the base 4.

The base 4 of the seam clip 3 may secure to the barrier plate 2 as illustrated in FIG. 1B. The barrier plate 2 may be capable of securing the seam clip 3 without direct attachment of the seam clip 3 to the purlins. Advantageously, in such an embodiment, heat in the seam clip body 8 does not directly pass from the seam clip body 8 to the purlins. No portion of the seam clip 3 is directly connected to the structure or purlin. The seam clip 3 is only directly attached to the adjoining roofing panels and the barrier plate 2. Heat may be conducted from the roofing assembly through the seam clip body 8. The barrier plate 2 may be dissipated from the seam clip body 8.

Figure 2:
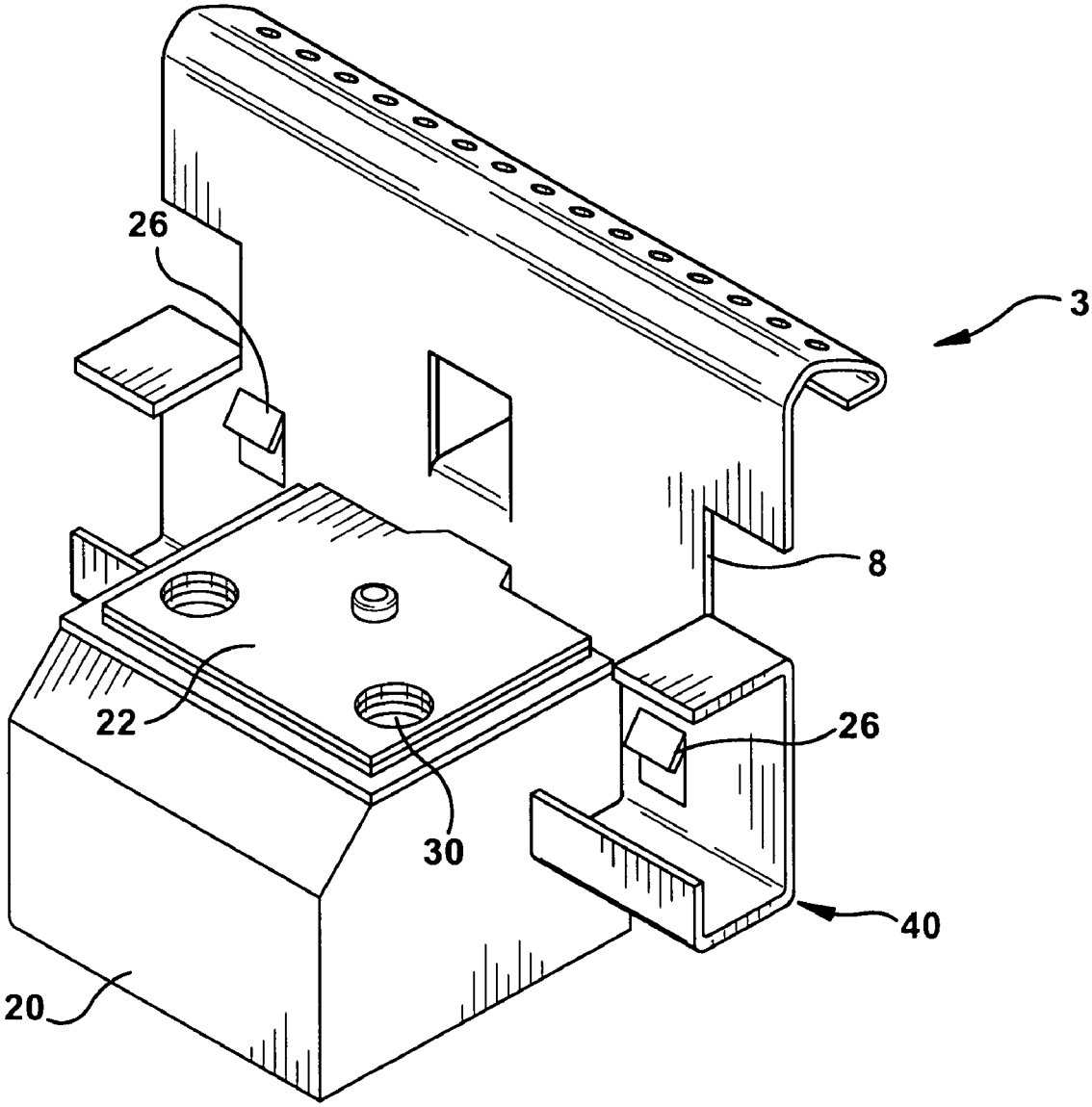
FIG. 2 is a perspective view of a seam clip body connected to a thermal block in an embodiment of the present invention.

FIG. 2 illustrates another embodiment of a thermal barrier. The seam clip body 8 may be secured to a thermal block 20 as shown in FIG. 2. In an embodiment, the thermal block 20 is made of a material having a low thermal conductivity, such as, a thermoplastic, for example, nylon. It should be understood that the thermal block 20 may be any size and shape as will be appreciated by one of ordinary skill in the art.

The thermal block 20 may be attachable to purlins, for example, to connect the seam clip body 8 to the purlins. In an embodiment, the thermal block 20 may be directly attached to the seam clip body 8. For example, a base 40 of the seam clip 3 may be sized and shaped to connect to the thermal block 20. As shown, in an embodiment, the base 40 of the seam clip 3 may be inserted into the thermal block 20, such as by sliding the base 40 of the seam clip 3 into the thermal block 20. The connection of the seam clip 3 to the thermal block 20 should not be deemed as limited to any specific manner. The thermal block 20 may be connected to or secured to the seam clip 3 in numerous manners appreciated by one of ordinary skill in the art.

A plate 22 may be positioned on the thermal block 20. The plate 22 may be a durable material and may be capable of applying pressure and/or compressing the thermal block 20. The plate 22 may be attached to and/or may be connected to the thermal block 20 such that the plate 22 compresses the thermal block 20. In such an embodiment, the thermal conductivity of the thermal barrier may be further decreased by compression of the thermal block 20 against the seam clip 3.

The plate 22 may have apertures 30, and the apertures 30 may extend through the thermal block 20. The apertures 30 may permit fasteners, such as, nails, bolts, screws or the like to attach the thermal block 20 to the purlins or other structure. Fasteners may only directly connect the thermal block 20 to the purlin. For example, the seam clip 3 may be connected to the thermal block 20 and the purlins without direct connection of the fasteners with the seam clip 3. The fasteners may extend through the thermal block 20 without contacting the seam clip 3. Accordingly, in an embodiment, the seam clip 3 is capable of securing to the purlin without any direct connection to the purlin. The thermal block 20 may prevent heat or at least limit heat conduction from the seam clip 3 into the interior of the structure, such as purlins that may be used to form the structure.

Centering tabs 26 may be attached to, secured to and/or integrally formed with the seam clip body 8. The centering tabs 26 may be protrusions, biased members or any mechanism capable of limiting axial movement of the seam clip 3 with respect to the thermal block 20. The centering tabs 26 may properly position the clip body 8 with respect to the thermal block 20. The centering tabs 26 may be biased into a locked position, for example. The centering tabs 26 may be positioned such that seam clip body 8 is at least partially moveable in the axial direction to allow for compression, expansion, and any other desired movement of the adjoining roofing panels, for example.

In an embodiment, the seam clip 3 may be secured to the thermal block 20 and the barrier plate 2. For example, the seam clip 3 may be secured to the thermal block 20, and the thermal block 20 may be secured to the barrier plate 2. In such an embodiment, heat conducted from the seam clip 3 may be prevented or at least limited from entering the structure within the adjoining roofing panels by the thermal block 20. Any heat conducting through the thermal block 20 may be dissipated or otherwise prevented from conduction into the purlins or interior of the structure by the barrier plate 2. The retaining clips 6 may be sized and shaped to secure the thermal block 20 to the barrier plate 2. The thermal block 20 and the barrier plate 2 may be connected in any other manner, such as by use of fasteners extending through the thermal block 20 and/or extending into the barrier plate 2.

In another embodiment, the barrier plate 2 may incorporate embodiments the structure of the thermal bock 20. For example, the barrier plate 2 may permit the seam clip 3 to be positioned within the body of the barrier plate 2. In such an embodiment, the barrier plate 2 may prevent direct attachment of the seam clip 3 to the purlins or structure.

In yet another embodiment, the barrier plate 2 may be connected to and/or secured to one or more thermal blocks 20. For example, the barrier plate 2 may be inserted into one or more of the thermal blocks 20 to prevent heat passing through the barrier plate 2 to be transmitted into the interior of the structure.

The present invention provides a seam clip 3 having an improved thermal barrier for preventing heat conduction from the seam clip 3. While specific embodiments of the connection of the seam clip to thermal barriers and orientation of those components have been described, one of ordinary skill in the art will appreciate that other connections and orientations are within the spirit of the present invention.

Although the preferred embodiment of the present invention has been illustrated in the accompanying drawing and described in the foregoing detailed description, it is to be understood that the present invention is not to be limited to just the preferred embodiment disclosed, but that the invention described herein is capable of numerous rearrangements, modifications and substitutions without departing from the scope of the claims hereafter.

Having thus described the invention, the following is claimed:

1. A seam clip assembly connectable to a building structure, the seam clip assembly comprising:

a seam clip having a base portion and a clip portion;

a thermal barrier secured to the seam clip, the thermal barrier capable of limiting heat conduction from the seam clip into the building structure, wherein the seam clip is securable to the building structure without direct connection to the building structure;

at least one spring loaded clip integrally formed with the thermal barrier wherein the thermal barrier is secured to the seam clip by the at least one spring loaded clip; and a base aperture located in the base portion, wherein the base aperture permits expansion, contraction, and axial movement in aligning the clip portion.

2. The seam clip assembly of claim 1 wherein the thermal barrier is capable of being directly attached to the building structure.

3. The seam clip assembly of claim 2 wherein the thermal barrier is capable of being connected to the building structure with fasteners that are not directly connected to the seam clip.

4. The seam clip assembly of claim 1 wherein the thermal barrier is a barrier plate having a substantially larger surface area than the seam clip.

5. The seam clip assembly of claim 1 wherein the thermal barrier is a thermal block.

6. The seam clip assembly of claim 1, wherein the at least one spring loaded clip comprises a pair of spring loaded clips integrally formed with the thermal barrier wherein the thermal barrier is secured to the seam clip by the pair of spring loaded clips.

7. The seam clip assembly of claim 1, further comprising a body positioned between the base portion and the clip portion, the body having a protrusion engaged with the base aperture permitting expansion, contraction and axial movement in aligning the clip portion.

8. A seam clip assembly for securing adjoining roofing panels to a structure, the seam clip assembly comprising:

a seam clip having a base, a body portion, and a clip portion, wherein the body portion is positionable with respect to the base;

a thermal barrier plate secured to the seam clip by a fastening device integrally formed with the thermal barrier plate, the thermal barrier plate having a larger surface area than the seam clip, the thermal barrier plate capable of connecting the seam clip to the structure without direct attachment of the seam clip to the structure;

wherein the body portion of the seam clip has a slide stop for allowing a predetermined amount of axial movement of the seam clip with respect to the thermal barrier plate;

a protruding member attached to the body portion; and an aperture positioned on the base, wherein engagement of the protruding member and the aperture aligns the body portion with respect to the base.

9. The seam clip assembly of claim 8 wherein the thermal barrier plate is capable of direct attachment to the structure.

10. The seam clip assembly of claim 8 wherein the retaining clip comprises a spring clip for securing the seam clip to the thermal barrier plate without direct attachment to the structure.

11. The seam clip assembly of claim 8 wherein the thermal barrier plate has a lower thermal conductivity than the seam clip.

12. The seam clip assembly of claim 8, wherein engagement of the protruding member and the aperture allow a predetermined amount of axial movement of the body portion with respect to the base to allow for expansion and contraction.

13. A seam clip assembly connectable to a building structure, the seam clip assembly comprising:

a seam clip having a base, a body, and a clip portion;

a thermal barrier having at least one integrally formed retaining spring loaded clip wherein the seam clip is secured to the thermal barrier by the retaining spring loaded clip and the seam clip is securable to the building structure without direct connection to the building structure;

a protrusion extending from the body; and an aperture positioned on the base, wherein engagement of the protrusion with the aperture permits expansion, contraction and axial movement of the body with respect to the base.

14. The seam clip assembly of claim 13 wherein the body and the clip portion are integrally formed.

15. The seam clip assembly of claim 13 wherein the body of the seam clip has a slide stop for allowing a predetermined amount of axial movement of the seam clip with respect to the thermal barrier.

16. The seam clip assembly of claim 13 wherein the retaining clip comprises a pair of spring clips.

* * * * *